United States Patent [19]

Womack

[11] 4,057,030

[45] Nov. 8, 1977

[54] RIGID GOLF FLAG WITH RESILIENT PERIPHERAL EDGE

[76] Inventor: Eugene S. Womack, P.O. Box 791, Mexia, Tex. 76667

[21] Appl. No.: 709,728

[22] Filed: July 29, 1976

[51] Int. Cl.[2] ..... G09F 17/00

[52] U.S. Cl. ..... 116/175; 116/120; 273/34 R

[58] Field of Search ..... 116/175, 120, 63 P, 116/173; 40/138, 139, 125 H, 145 R; 273/32, 34 R

[56] References Cited

U.S. PATENT DOCUMENTS

| | | | |
|---|---|---|---|
| 429,214 | 6/1890 | Lanius | 116/175 |
| 1,069,776 | 8/1913 | Foulis | 116/173 X |
| 1,804,293 | 5/1931 | Warzoha | 116/173 |
| 2,417,367 | 3/1947 | Leach | 116/175 |
| 3,075,492 | 1/1963 | Winfrey | 116/173 X |
| 3,183,886 | 5/1965 | Moffitt, Jr. | 40/125 R X |
| 3,777,428 | 12/1973 | Caufield | 116/63 P X |

*Primary Examiner*—Daniel M. Yasich

*Attorney, Agent, or Firm*—Clarence A. O'Brien; Harvey B. Jacobson

[57] ABSTRACT

A rigid golf flag having a resilient peripheral edge is provided for the purpose of long wear and minimum maintenance. Rigid golf flags of metal or plastic will last a long time, practically indefinitely, thereby cutting the cost of operating and maintaining a golf course. A resilient protective edge covers substantially all of the peripheral edge of the rigid flag for the purpose of keeping the flag from cutting into the greens of the golf course when and if dropped by a player or caddy.

4 Claims, 8 Drawing Figures

RIGID GOLF FLAG WITH RESILIENT PERIPHERAL EDGE

BACKGROUND OF THE INVENTION

1. Field of the Invention

This invention relates generally to flags for use with the numbered holes on conventional type golf courses and especially to a flag made of rigid material and having a resilient peripheral edge.

2. Description of the Prior Art

A common problem with known type flags for use on golf courses is that they are generally made of cloth which wear out quite fast and are relatively expensive.

Another problem with known devices of the semi-rigid type is that when and if they are dropped by a careless or impatient player, they often damage the greens of the golf course by slicing and cutting into same due to the sharp, rigid edge of such type flag. This is quite detrimental to the maintenance of the green as well as cutting down the smooth, intact surface of the green for good putting. A cut or slice in normal lawn grass or yard grass does not mean much. However, on a putting green, just a small imperfection in same can be quite detrimental to the players. It is extremely important, therefore, that nothing be present to damage or cut the surface of the greens.

Known prior art patents which may be pertinent to this invention are as follows:

U.S. Pat. No. 1,069,776, D. Foulis, Aug. 12, 1913;
U.S. Pat. No. 1,582,931, D. Kennedy, May 4, 1926;
U.S. Pat. No. 1,672,134, B. F. Pitt et al., June 5, 1928;
U.S. Pat. No. 1,804,293, S. Warzoha, May 5, 1931;
U.S. Pat. No. 2,280,817, A. C. Freeman, April 28, 1942;
U.S. Pat. No. 3,075,492, L. L. Winfrey, Jan. 29, 1963.

None of these known prior art devices offers the new and unique features of the invention disclosed herein.

SUMMARY OF THE INVENTION

An object of the present invention is to provide a rigid golf flag with a resilient peripheral edge for the purpose of long wear, relatively little maintenance, and to prevent damage to a golf green when and if said flag is carelessly dropped thereupon.

Another object of the present invention is to provide a rigid golf flag mounted upon a rigid pole which will fit downwardly into and be supported by a conventional type golf hole cup bottom recess and hold the flag in good viewing position for clear unobstructed viewing by a golfer at a substantial distance therefrom.

Another further object of this invention is to provide a golf flag having a support staff and being securely, yet pivotally mounted therefrom, for supporting said flag with the number or indicia printed thereon clearly visible from substantial distances on the golf green.

A still further additional object of this invention is to provide a rigid golf flag having a resilient peripheral edge supported from a flag staff which is easily insertable into the conventional golf holes provided on the putting greens and which will be pivotally mounted so as to normally assume a direction parallel or in alignment with the prevailing wind to provide a good indication to a player at a substantial distance therefrom of the correct direction of the prevailing wind at that particular golf hole.

The rigid golf flag with a resilient peripheral edge of this invention provides a device which will have long life and be maintenance free, and will not injure the golf green when carelessly dropped thereon. Also, the flag is mounted from a three-loop support member which is in turn supported at two points from the primary support staff. This permits the entire flag with support structure to pivot about the flag staff itself. This construction positively maintains the flag member in a proper vertical position for easy viewing by a golfer at great distances, as well as allowing said flag member to freely turn with the wind in order to indicate the direction of such wind, even if the breeze or wind is very light. This is an additional important feature because even a slight amount of wind and the gusts thereof will affect the path of flight of the golf ball.

The flag member itself may be made of hard rigid plastic, or of aluminum, steel, plywood, or like materials which are rigid and have relatively long life. However, such rigid materials do present relatively sharp edges which if dropped upon a golf green will tend to slice or cut into same. This can be quite detrimental to the green and is a serious drawback to the use of rigid type flag material. Usually cloth type flags are used to eliminate this problem. However, with the invention disclosed herein a resilient edge covering is provided over substantially all of the edge of the rigid flag member. This resilient material may be of soft plastic, or of rubber tubing, or teflon, or the like. The basic requirement being that it be of good wearing qualities and yet relatively resilient and elastic.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 4:
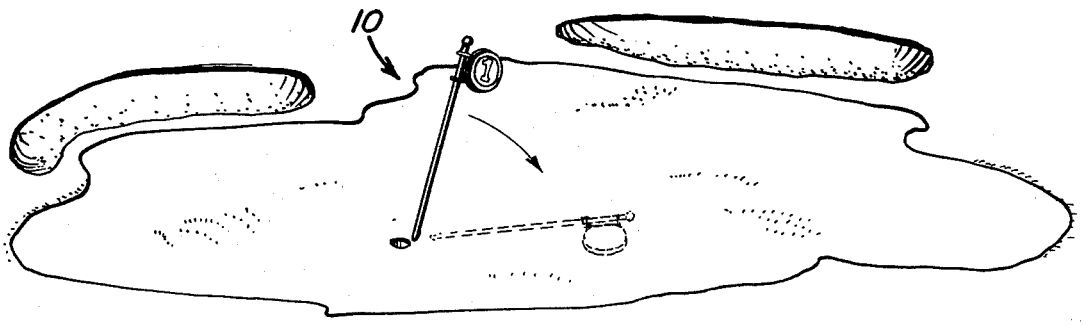
FIG. 4 is a perspective view of the golf flag device of this invention as in use.

Referring to FIG. 4 of the drawings, reference numeral 10 indicates in general the golf flag device of this invention as in use. Such gold flags are normally supported and mounted within the golf hole cup as provided in the putting green with the purpose being to indicate to a golfer, at a fair distance, away the correct position of the hole and the number of same. Another reason for the golf flag is to give the golfer an indication of the direction of the prevailing wind at the particular green. These features being of great importance to golfers, it is in turn important that the flag be appropriately supported at a proper distance above the golf hole for the particular green and also be mounted so that it will freely turn with the wind even though such wind may be very, very light. It is also very important that when the golfer or his caddy removes the flag staff from the hole and carelessly drops same upon the green, there will be no edges or protruding parts which will cut or dig into the green itself. One of the important features of this particular invention is in the covering of the entire exposed edge of the flag member with a resilient edging portion which will prevent such injury to the green if the flag device is carelessly dropped.

Figure 1:
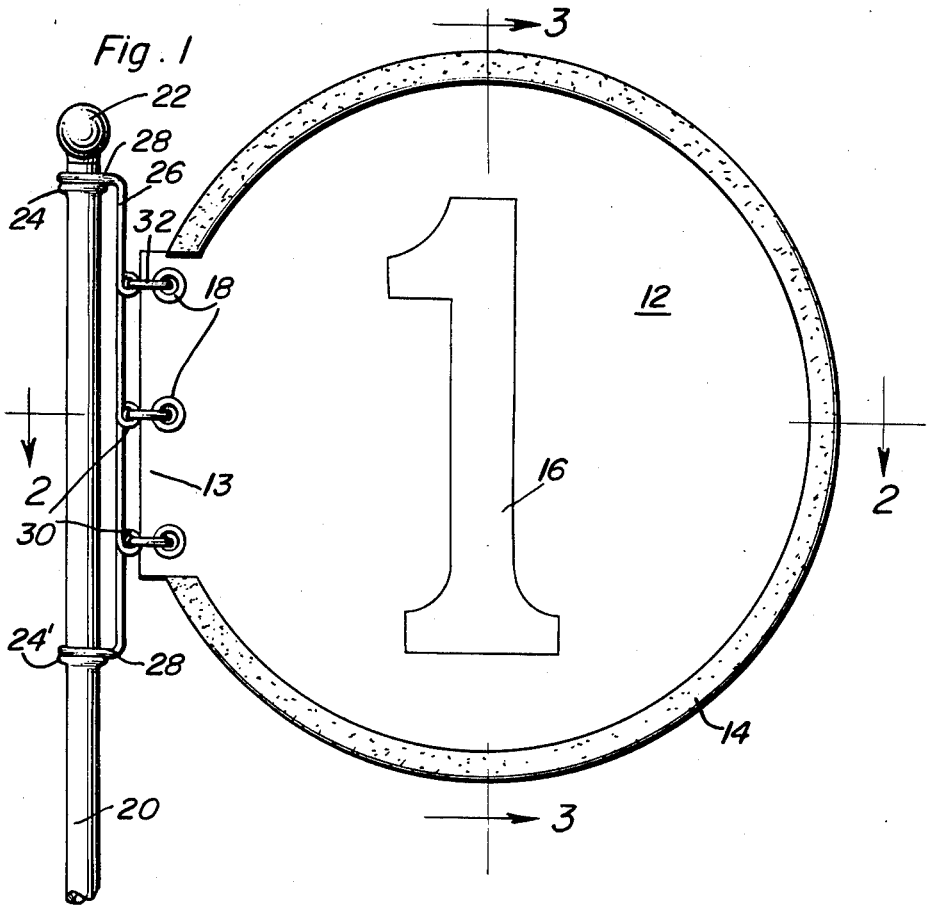
FIG. 1 is a side elevational view of the flag device and support structure of this invention.
Figure 3:
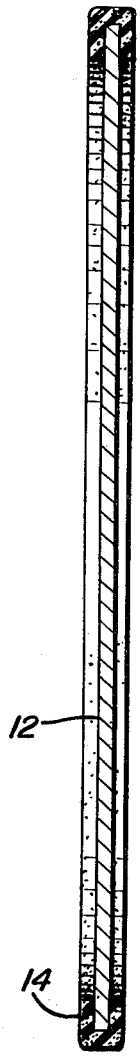
FIG. 3 is an end view, partly in cross section, taken generally along line 3—3 of FIG. 1.

Looking at FIGS. 1, 2 and 3, the device will now be described in detail. The main flag member 12 is substantially circular in shape, having though one short straight side or rectangular tab portion 13. The edge of the flag member which is circular and forms most of the outer peripheral portion of the member is covered with a resilient and elastic covering 14. An appropriate numeral or indicia 16 is provided for each of the golf course with which these flags are being used, i.e., 1–9, or 1–18, etc.

The straight side or rectangular tab portion 13 of the flag member has apertures 17 aligned along and set in from the outer edge thereof with these apertures 17 being appropriately lined with reinforcing grommets 18. The grommets may be of hard metallic material, or any equivalent long wearing and strong material. The rigid flag member 12 preferably is made of hard plastic or aluminum material. However, other rigid type materials such as steel, plywood, and the like, may be used. The resilient edge covering material 14 is preferably of soft plastic material or of rubber hose type material. The edge covering 14 normally will be retained securely and positively in place by appropriate epoxy glue or the like.

Looking at FIGS. 1 and 2 of the drawings, the support and pivotal mounting of the flag member will be now be described in detail. This mounting is another important feature of this invention in that it allows complete 360° swiveling of the flag member 12 about the flag staff 20 and also securely and positively maintains the flag member 12 in a vertical upright position for easy viewing and reading of the inscribed or printed number 16 provided thereon. The flag staff 20 includes a detachable upward movement limiting ball 22 removably mounted on the staff 20 by screw means or the like, not shown, at the top thereof. Spaced a slight distance below the removable ball 22 is a pivot flange 24 with another pivot flange 24' provided a few inches therebelow. These pivot flanges 24 and 24' are secured by welding or the like to main flag support staff 20. They support for free pivotable movement therefrom rings 28 of a flag support member 26.

Figure 2:
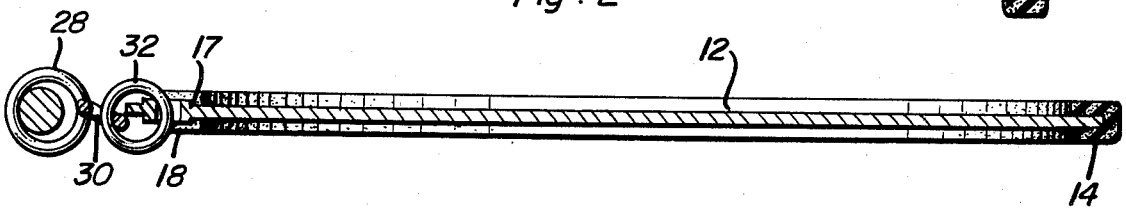
FIG. 2 is a top plan view, partly in cross section, taken generally along line 2—2 of FIG. 1.

As can be seen in FIG. 2, the rings 28 are substantially larger than the outer circumference of the flag staff 20. Thus, the flanges 24 and 24' pivotally support the flag support member 26 from the rings 28 thereof with only slight resistance to the turning thereof. At least three support loops 30 are formed and provided in the support member 26, and equally spaced between the rings 28, as best seen in FIG. 1. These loops 30, in turn, are connected to the flag member 12 by means of the links 32 which pass through the loops 30 and through the reinforcing grommets 18.

Thus, as can be readily visualized by looking at FIG. 2, with a very slight breeze the links or O-rings 32 will permit the flag member to whip or generally turn with such light breeze. Then, with a slightly heavier wind, the entire structure of 26, loops 28, and support loops 30 will pivot about the flag staff to align the flag member as well as the support structure with the wind. This entire structure, and especially the double support flanges 24 for the two pivotable rings 28 adds greatly to the overall features of the invention. Then the rigid flag member 12 with the resilient edge covering 14 to prevent damage to the golf green when dropped thereupon offers long life with minimum damage to the golf greens.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

What is claimed as new is as follows:

1. A golf hole flag assembly, said assembly including an upright staff adapted to be supported upright from a hole cup, the upper end portion of said staff including vertically spaced upper and lower horizontally enlarged and outwardly projecting flanges extending thereabout and including upper bearing surfaces, a flag support including an upstanding rod provided with vertically spaced and aligned horizontally outstanding upper and lower support rings on its upper and lower end rotatably mounted on said staff with the upper and lower rings disposed above and rotatably engaged with said bearing surfaces and said rod spaced outwardly from said staff and flanges, an upstanding flag member including an upstanding rigid panel member constructed of weather resistant material, said panel member being generally circular in shape, but including one straight upstanding side marginal edge portion at one side edge thereof provided with vertically spaced and aligned horizontal transverse apertures formed therethrough, said straight upstanding marginal edge portion being defined by an integral horizontally outwardly projecting and elongated upstanding tab portion of said panel member, the peripheral edge portion of said panel member extending thereabout from the upper end of said tab portion to the lower end of said tab portion being substantially continuously arcuate and having a resilient covering secured thereover to protect the greens grass from damage if dropped thereupon, said rod intermediate the upper and lower ends thereof, including means defining vertically spaced loops supported therefrom, said apertures being horizontally registered with said loops, and attaching links loosely passed through corresponding pairs of apertures and loops supporting said panel member from said rod for angular displacement relative thereto about an axis paralleling said staff and thus the axis of angular displacement of said flag support about said staff.

2. The structure as set forth in claim 1, wherein the flag member is made of hard plastic material, and the resilient covering is made of soft plastic material.

3. The structure as set forth in claim 1, wherein the flag member is made of rigid aluminum sheet material, and the resilient covering is made of rubber material.

4. The structure as set forth in claim 1, wherein at least three apertures are provided in the top portion, at least three loops are provided in the support rod, at least three connecting links are provided for connecting the apertures with the loops, and reinforcing members are provided for the apertures of the flag member.

* * * * *